US005282574A

United States Patent [19]

Koch

[11] Patent Number: 5,282,574

[45] Date of Patent: Feb. 1, 1994

[54] HYDRAULIC FLOW SHUTOFF DEVICE FOR A UNIT FUEL PUMP/INJECTOR

[75] Inventor: Roger D. Koch, Pekin, Ill.

[73] Assignee: Caterpillar Inc., Peoria, Ill.

[21] Appl. No.: 65,697

[22] Filed: May 21, 1993

Related U.S. Application Data

[63] Continuation of Ser. No. 810,084, Dec. 19, 1991, abandoned.

[51] Int. Cl.[5] ..... F02M 47/02

[52] U.S. Cl. ..... 239/90

[58] Field of Search ..... 239/88-90

[56] References Cited

U.S. PATENT DOCUMENTS

| | | | |
|---|---|---|---|
| 1,981,913 | 11/1934 | Fielden | 103/41 |
| 4,211,202 | 7/1980 | Hafner | 239/88 X |
| 4,408,718 | 10/1983 | Wich | 239/88 |
| 4,527,737 | 7/1985 | Deckard | 239/89 |
| 4,527,738 | 7/1985 | Martin | 239/90 |
| 4,601,269 | 7/1986 | Kato et al. | 230/88 X |
| 4,750,462 | 6/1988 | Egler et al. | 239/88 X |
| 4,782,807 | 11/1988 | Takahashi | 123/506 |
| 4,784,102 | 11/1988 | Igashira et al. | 123/447 |
| 5,056,488 | 10/1991 | Eckert | 239/88 X |

OTHER PUBLICATIONS

"Fuel Injectors and Injection Systems", Chapter 8, pp. 53-57, 70-73, and 83, Diesel, Fundamentals, Service, Repair, By: W. K. Toboldt, Copyright 1977.

"Injecting Fuel", Chapter 14, pp. 240-245, 268-270, Diesel and High Compression Gas Engines, 3rd Edition, By E. J. Kates, Copyright 1974.

"Diesel Fuel Injection", Chapter 20, pp. 317-321, Diesel Fundamentals-Principles & Service, 2nd Edition, By F. J. Thiesen and D. N. Dales, Copyright 1986.

*Primary Examiner*—Andres Kashnikow
*Assistant Examiner*—Kevin P. Weldon
*Attorney, Agent, or Firm*—J. Wesley Blumenshine

[57] ABSTRACT

The present invention is an improvement to fuel pumps/injectors in which fuel is pressurized in a fuel chamber to a pressure great enough to open an injection valve allowing the fuel to be ejected under pressure into the combustion cylinder of an engine. More particularly, the present invention is a device positioned in the fuel path which typically runs from the plunger chamber to the injection valve. For injection, the device is positioned to allow fuel to flow from the plunger to the injection valve. To end injection, the device closes off the flow of fuel thereby separating the fuel path into two portions. The drainage of fuel from the first portion is restricted by an orifice, thereby maintaining pressure in the first portion which prevents the fuel pressurizing mechanism components from separating. In the second portion, pressure is vented back to the fuel supply manifold thereby allowing the injection valve to quickly close, ending injection.

2 Claims, 6 Drawing Sheets

HYDRAULIC FLOW SHUTOFF DEVICE FOR A UNIT FUEL PUMP/INJECTOR

This is a continuation of Ser. No. 07/810,084, filed Dec. 19, 1991, now abandoned.

TECHNICAL FIELD

Fuel pumps/injectors having a means for pressurizing fuel in a fuel chamber to a pressure which opens an injection valve allowing the fuel to be ejected under pressure into the piston cylinder of an engine, and more particularly to an apparatus and method for decreasing the minimum controllable volume of fuel which may be injected and for maintaining pressure in the fuel chamber at the end of injection.

BACKGROUND ART

In order to meet ever increasing consumer and governmental requirements for fuel economy, performance, and emissions, the trend in engine fuel systems is to change from a centrally located fuel pump with multiple plungers connected via fuel pathways to each combustion cylinder (commonly known as pump and line fuel systems), to unit fuel pumps/injectors which are placed over the combustion cylinder. In this way, the volume associated with fuel pathways is greatly reduced enabling higher injection pressures to be obtained and eliminating fuel line dynamics, leading to better engine performance.

Although not shown, in general, unit pumps differ from unit injectors only by the fact that the injector body is not placed over the combustion cylinder. Instead, the main body of the device is placed remotely from the combustion cylinder and connected by means of a heavy-duty fuel line to the injection tip, which is over the combustion cylinder. Remote positioning of the main body of the device allows more space in the cylinder head to be allocated for intake and exhaust valves. It also makes possible a more stiff drive mechanism, especially if the push rod/rocker arm mechanism is eliminated. Both mechanical and electronic unit pumps are possible.

Even pumps/injectors (hereinafter referred to as "injectors") have certain undesirable characteristics. Namely, it is difficult to achieve low minimum controllable fuel delivery volume. This is a problem because when the amount of fuel required by an unloaded engine is less than the minimum controllable fuel delivery volume of the injector, misfire or instability can occur. Also, the rapid release of hydraulic pressure in the injectors after injection causes high loads, noise, and wear in the plunger and plunger drive mechanism.

FIG. 1 of the drawings shows a mechanical injector and its drive mechanism. Working of the drive mechanism and injector is explained later under the "BEST MODE" section of this case. However, for present purposes, it is important to understand the failings of such an injector. When fuel is being ejected, significant energy is stored in the drive mechanism due to deflection of its components and supports. When injection is finished, pressure on the plunger drops rapidly. This releases the load on the drive mechanism and allows it to spring apart or separate. The separation usually occurs at the push rod ends, but may also occur at other interfaces. A short time after separation, those parts of the drive mechanism which have separated are pushed back into contact by the injector return spring. The resulting impact causes high loads, noise, and wear of components in the drive mechanism and the gear train which drives the cam shaft.

Referring now to FIG. 2, an electronic injector is shown. The main difference between mechanical and electronic injectors is the method in which the fuel is bypassed from the fuel chamber to end or control injection. Although an electronic injector has a plunger, it is much simplified when compared to the mechanical injector. This is because there is no need for a rack bar, nor for the gear to rotate the plunger, nor for the scroll to be cut into the plunger for the purpose of starting and stopping bypass flow (these terms and their purpose are explained fully in the "BEST MODE" section of this case).

Bypass of fuel from the fuel chamber is controlled by a solenoid. With the solenoid de-energized, fuel can escape from the fuel chamber through a pathway, past the poppet seal land, and exit by way of another pathway to the fuel supply manifold. Therefore, no appreciable pressure is maintained below the plunger and the drive mechanism components can spring apart.

When the solenoid is energized, the poppet is pulled upward causing the poppet seal land to seat and shut off bypass flow. The pressure then increases in the fuel chamber and injection occurs in a manner quite similar to the mechanical injector. Injection ends when the solenoid is de-energized and the bypass is re-opened.

Now looking at FIG. 3, one attempt for improving an injector's minimum controllable fuel delivery volume is known as spill pulse assisted needle closure (SPANC), which is intended to provide a more rapid closure of the needle valve. It is also intended to reduce high loads, noise, and component wear in the drive mechanism by maintaining sufficient pressure in the fuel chamber until the cam follower reaches maximum lift. In an injector with the SPANC device, when the plunger nears the end of its pumping stroke, the bypass port is uncovered. The pressure pulse of fuel from the fuel chamber out the bypass port is restricted by an orifice and a portion of the pulse is re-directed through a pathway to a piston which sits above the needle valve. The pressure pulse force on the upper surface of the piston causes it to quickly move down against the needle valve, thereby quickly closing the needle valve.

Contrary to the original intent, tests of a SPANC device have shown that the minimum controllable fuel delivery volume is actually increased. This apparently follows from the fact that because the pressure pulse applied to the top of the piston also makes its way to the needle valve fuel chamber, flow out the tip orifices is at a faster rate, thus an increased volume of fuel is delivered before the pressure in the needle valve fuel chamber dissipates enough for the needle valve to close.

The present invention is intended to solve problems inherent in prior injectors by improving minimum controllable fuel delivery volume and by maintaining enough pressure in the fuel chamber at the end of injection to eliminate the ability of the drive mechanism components to separate.

DISCLOSURE OF THE INVENTION

In one aspect of the present invention, a fuel injector is provided having improved capability of controlling minimum fuel delivery volume while at the same time maintaining adequate pressure in the fuel chamber at the end of injection to maintain force against the drive mechanism and prevent the drive mechanism components from springing apart.

The injector includes a fuel chamber having first and second portions and a fuel inlet connectable to a fuel supply. The injector also includes a plunger connected to a drive mechanism which together form a means for compressing and thereby pressurizing fuel in the fuel chamber to an injection pressure. The injector also includes an injection valve displaceable by the force of the pressurized fuel from an injection off to an injection on position, the valve being spring biased to the injection off position.

The improvement is the provision in the injector of a fuel flow interrupting means for interrupting fuel flow between the first and second portions of the fuel chamber, such as by use of a spool valve axially displaceable between a flow on position and a flow off position. The fuel flow interrupting means allows fuel to flow from the first portion of the fuel chamber to the second portion during injection but then controllably restricts, perhaps totally cutting-off, the flow of fuel from the first portion to the second portion at the end of injection. In this way, pressure is maintained in the first portion of the fuel chamber and force is maintained against the plunger thus preventing the drive mechanism components from springing apart.

In a preferred embodiment, the spool valve is spring biased to the flow on position and displaced to the flow off position by the force of a pressure wave which travels from the first portion of the fuel chamber through a pressure wave pathway to the spool valve cavity.

Preferably, pressure in the second portion of the injector is vented after the spool valve has moved to its flow off position to enable the injection valve to more quickly return to its injection off position.

In another aspect of the present invention, a method for ejecting fuel from the fuel injector is disclosed. The method includes the steps of:

providing fuel to the fuel chamber from the fuel supply via the fuel inlet;

pressurizing the fuel in the fuel chamber by the drive mechanism and plunger;

positioning the injection valve at the injection on position in response to the force of the pressurized fuel;

ejecting the fuel under pressure from the fuel chamber;

interrupting the flow of fuel from the first portion of the fuel chamber to the second portion;

maintaining pressure in the first portion of the fuel chamber and maintaining a force against the plunger;

dissipating pressure in the second portion of the fuel chamber; and moving the injection valve to the injection off position in response to the pressure dissipation, ending injection.

BEST MODE FOR CARRYING OUT THE INVENTION

Figure 4:
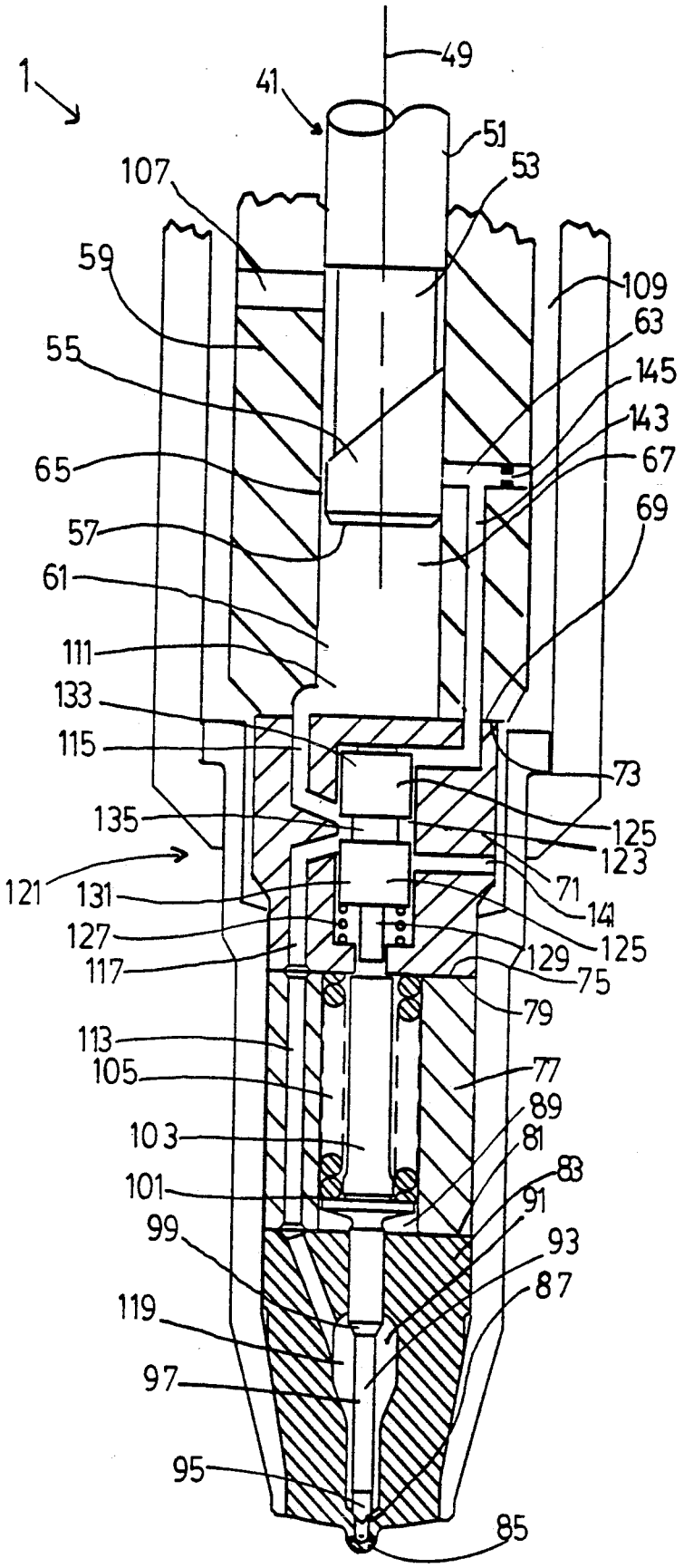
FIG. 4 is a depiction of the pertinent portion of the mechanical injector shown in FIG. 1 with a hydraulic flow shutoff device of the present invention installed and at the flow on position.

Looking now at FIG. 4, the pertinent portion of a unit injector 1, this one being of the mechanical type, having a hydraulic flow shutoff device 125 of the present invention, is shown.

Figure 1:
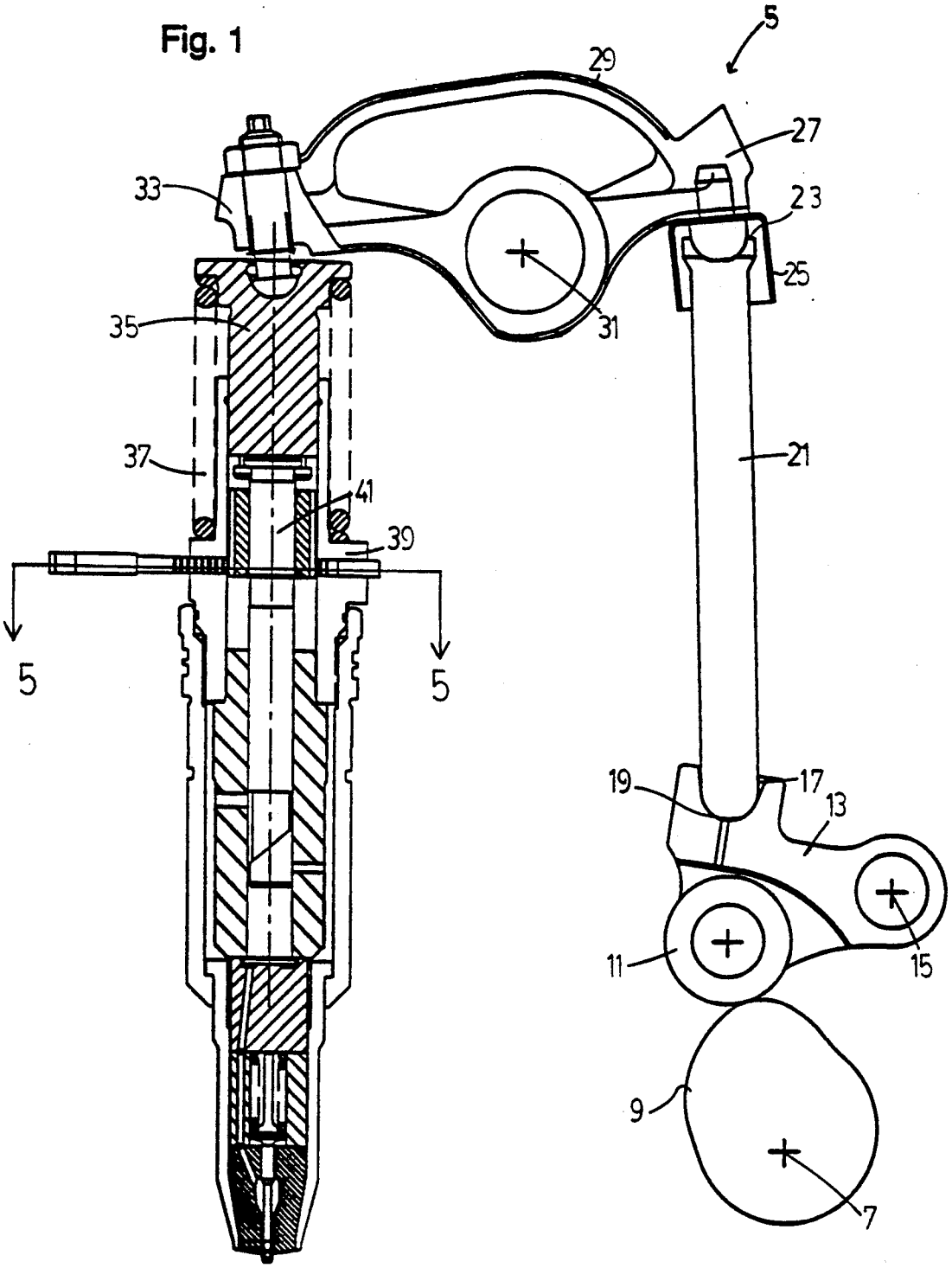
FIG. 1 is a depiction of a mechanical unit injector in cross-section and drive mechanism, the injector not including the present invention.

Force to pressurize the fuel is provided by a drive mechanism 5, such as the one shown in FIG. 1, which will now be described. Rotation of the cam shaft causes rotation of the cam lobe 9 which is fixedly connected to the cam shaft and also rotates about the axis 7. A roller follower 11 fixedly connected to a pivot arm 13 pivotal about the axis 15 rides on the cam lobe 9. Loosely riding within a cup 17 in the pivot arm 13 is the first end 19 of a push rod 21. The second end 23 of the push rod 21 loosely resides in a cap 25 at the first end 27 of a rocker arm 29, which is pivotable about the axis 31. The second end 33 of the rocker arm 29 is connected to the tappet 35 of the injector 1. Downward motion of the tappet 35 is resisted by the injector return spring 37 which seats against the injector body 39 and tappet 35.

Figure 5:
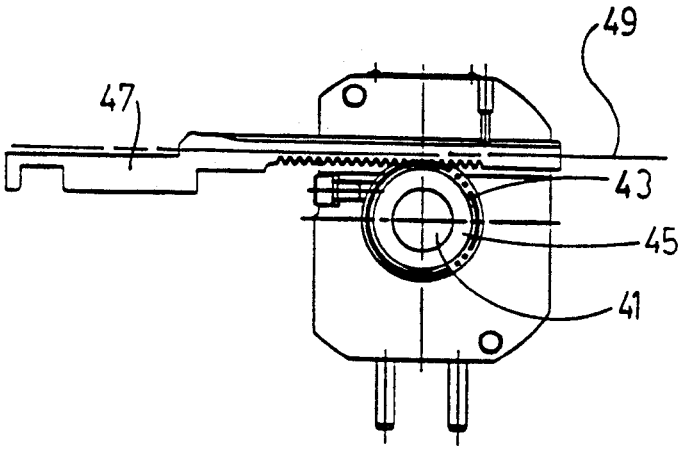
FIG. 5 is a top view taken through the pathway 5—5 of FIG. 1 showing the rack bar and pinion.

Inside the unit injector body 39, the tappet 35 is connected to the plunger 41. As shown in FIG. 5, a pinion 43 is loosely splined to the plunger 41 such that the plunger 41 can slide through the splines 45. When the rack bar 47 is pushed along its axis 49, it causes the pinion 43 and the plunger 41 to rotate about their common axis 49.

Now looking at FIG. 4, the plunger includes a first portion 51, a second portion 53 of lesser circumference connected to the first portion 51, and a third scrolled portion 55 connected to the second portion 53 and configured to allow fuel flow from the bottom 57 of the plunger 41 to the second portion 53, in this case by having a diameter less than the diameter of the barrel 59 and being offset from the axis 49 so that the third portion 55 can cover the bypass opening port 63, as explained below, while at the same time allowing fuel flow through the space 65. The plunger 41 slides inside the barrel 59. The drive mechanism 5 and plunger 41 together form the means for pressurizing fuel in the fuel chamber 67 and essentially pumping the fuel from the injector 1.

Adjacent the bottom 69 of the barrel 59 is a first spacer block 71 having a top 73 and a bottom 75. Adjacent the bottom 75 of the first spacer block 71 is a second spacer block 77 having a top 79 and a bottom 81. Adjacent the bottom 81 of the second spacer block 77 is a nozzle 83. The nozzle 83 includes a spray orifice 85 and an injection valve seat 87.

Within cylindrical cavities 89, 91 in the second spacer block 77 and the nozzle 83 is an injection valve 93, in this case a needle valve. The needle valve has a conical tip 95, a cylindrical needle portion 97 having a step 99, a return spring seat 101, a cylindrical stop portion 103, and a return spring 105 between the return spring seat 101 and the bottom 75 of the first spacer block 71. The needle valve 93 is movable between an injection off position at which the tip 95 is seated against the seat 87 and an injection on position at which the tip 95 is spaced from the seat 87.

Two ports, a bypass opening port (BPOP) 63 and a bypass closing port (BPCP) 107 serve as fuel inlets into the fuel chamber 67 for fuel flowing from the fuel supply manifold 109. The fuel chamber 67 includes a first portion 111 and a second portion 113. The first portion 111 includes the first pathway 115, the space below the bottom 57 of the plunger 41 and the space 61 around the second portion 53 of the plunger 41, as defined by the barrel 59 and the top 79 of the second spacer block 77, hereinafter referred to as the plunger chamber 61. The second portion 113 includes the second pathway 117 and the needle valve chamber 119.

The improvement of the present invention over the prior art is the provision of a means 121 for interrupting the flow of fuel from the first portion 111 of the fuel chamber 67 to the second portion 113 of the fuel chamber 67. Positioned within a cylindrical cavity 123 in the first spacer block 71 is a hydraulic flow shutoff device of the present invention, in this case a spool valve 125 axially displaceable between a flow on position and a flow off position. The spool valve 125 is biased to the flow on position, shown in FIG. 4, by a preloaded return spring 127. The spool valve 125 has a probe 127, a first land 131, a second land 133, and an annulus 135.

The first pathway 115 runs from the plunger chamber 61 to the spool valve cavity 123, the second pathway 117 runs from the spool valve cavity 123 to the needle valve chamber 119, a third pathway 141 runs from the spool valve cavity 123 to the fuel supply manifold 109, and a fourth pathway 143 runs from the BPOP 63 to the spool valve cavity 123. A restricted orifice 145 is located in the BPOP 63 beyond the fourth pathway 143.

Figure 2:
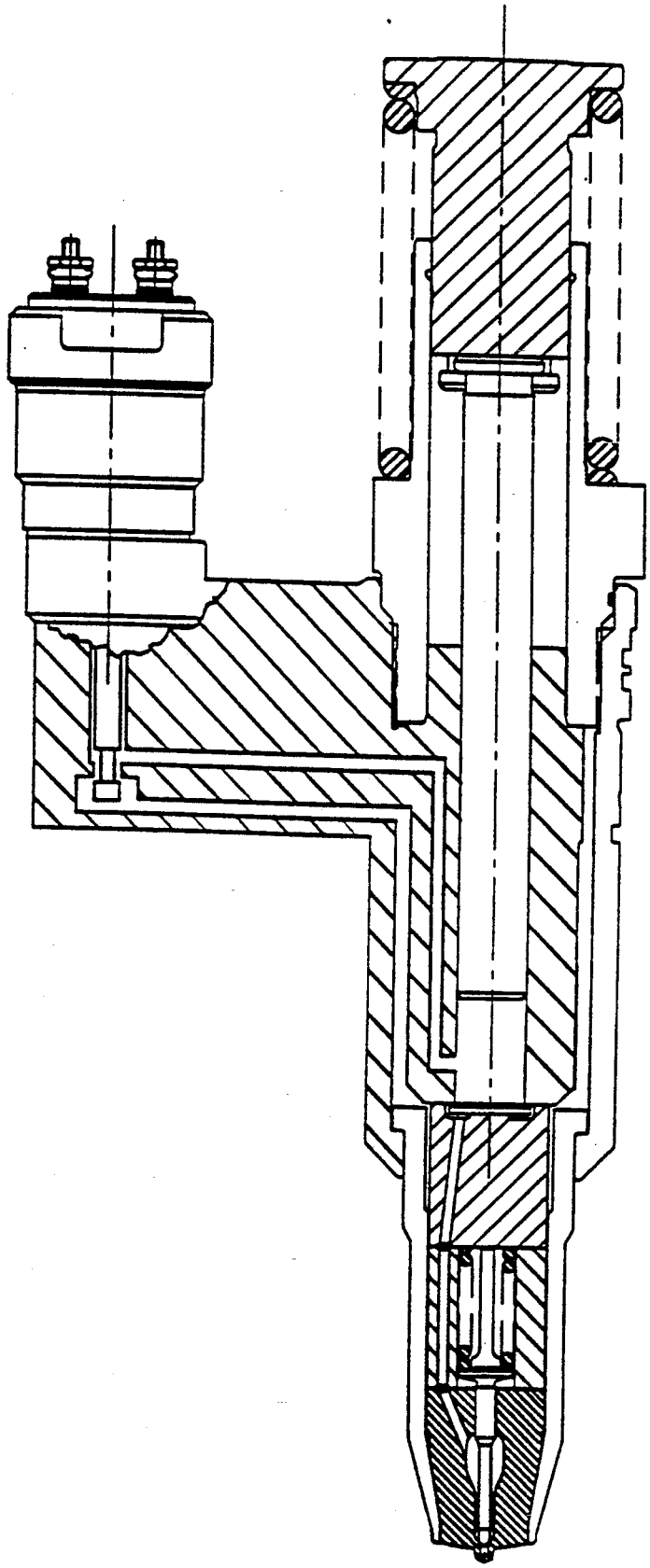
FIG. 2 is a depiction of an electronic unit injector in partial cross-section, not including the present invention.
Figure 3:
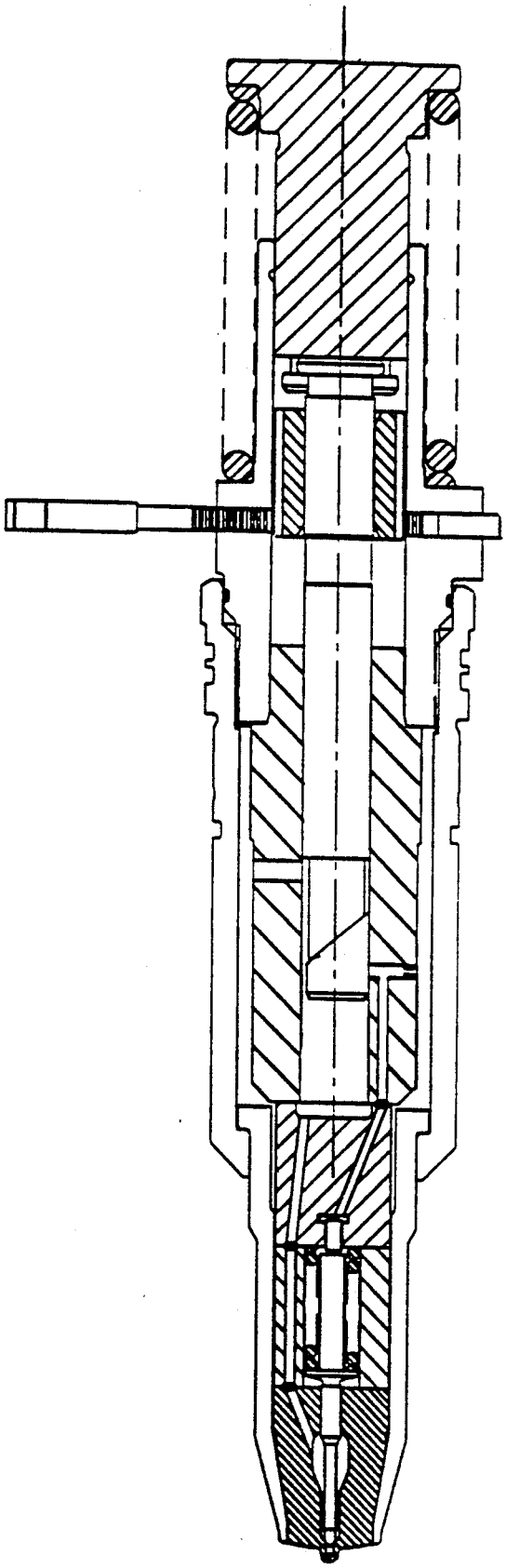
FIG. 3 is a depiction of a mechanical injector like that in FIG. 1 with a spill pulse assisted needle closure (SPANC) device installed.
Figure 6:
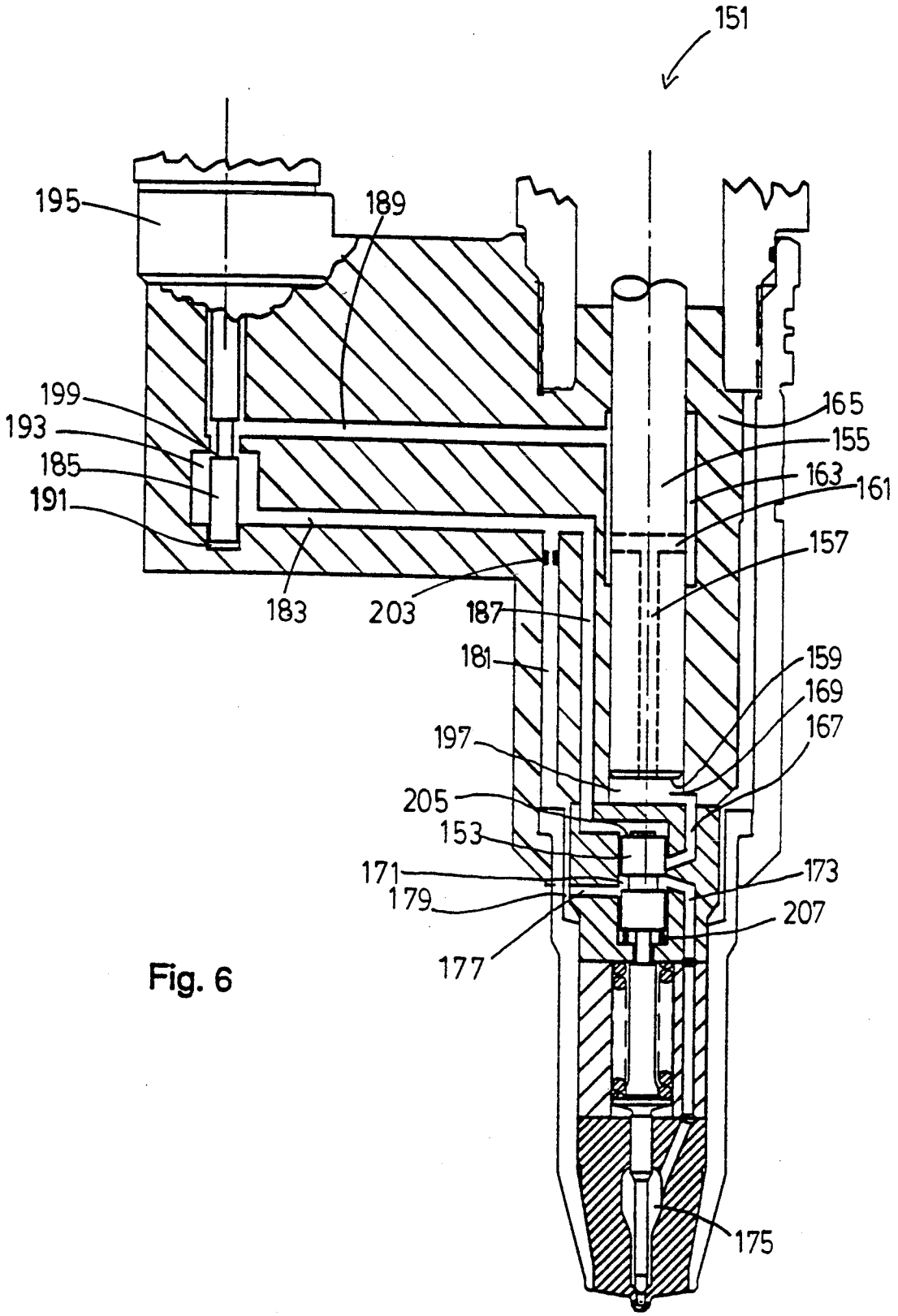
FIG. 6 is a depiction of the pertinent portion of the electronic injector shown in FIG. 2 with a hydraulic flow shutoff device of the present invention installed and at the flow off position.

The relevant portion of an electronic unit injector 151 having a hydraulic flow shutoff device of the present invention is shown in FIG. 6. Comparing the electronic injector 1 shown in FIG. 2 to the improved injector 151 shown in FIG. 6, besides the addition of the spool valve 153, as above described, modifications in the plunger 155 and the routing of fuel pathways are necessary.

The plunger 155 has a longitudinal bore 157 extending axially from the bottom end 159 of the plunger 155 upwards to a lateral bore 161. The lateral bore 161 communicates with an internal annulus 163 in the barrel 165. A first pathway 167 runs from the plunger chamber 169 to the spool valve cavity 171, a second pathway 173 runs from the spool valve cavity 171 to the needle valve chamber 175, a third pathway 177 runs from the spool valve cavity 171 to the fuel supply manifold 179, a fourth pathway 181 runs from the fuel supply manifold 179 through a first branch 183 to the solenoid poppet cavity 193 and through a second branch 187 to the spool valve cavity 171, and a fifth pathway 189 runs from the solenoid poppet cavity 193 to the annulus 163.

The bottom 191 of the solenoid poppet 185 and the bottom 137 of the solenoid poppet cavity 193 have close diametral clearance. The bottom 137 of the cavity 193 is connected to the first branch 183 of the fourth pathway by another pathway (not shown) to prevent unbalance of pressure loads on the poppet 185.

INDUSTRIAL APPLICABILITY

Referring again to the mechanical injector 1 of FIG. 4, before the drive mechanism 5 is set in motion, the second end 33 of the rocker arm 29, the tappet 35 and the plunger 41 are held in the up position by the injector return spring 37, the spool valve 125 is held in the flow on position by the spool valve return spring 127, the injection valve 93 is held in the injection off position by the needle valve return spring 105, and the BPOP 63 and BPCP 107 are uncovered thereby allowing fuel to fill the fuel chamber 67.

Force to pressurize the fuel is provided by the cam shaft mechanism. The cam shaft rotates about its center 7, causing the cam lobe 9 to displace the roller follower 11. This causes the pivot arm 13 to pivot about the axis 15. As the pivot arm 13 rotates it lifts the push rod 21 and causes the rocker arm 29 to rotate about its pivot 31. Rotation of the rocker arm 29 imparts downward motion to the tappet 35. The tappet 35 motion is resisted by the injector return spring 37.

Downward motion of the tappet 35 is imparted to the plunger 41. It is necessary that both ports 63, 107 be covered by the plunger 41 before any appreciable pressure will build up within the fuel chamber 67. As the plunger 41 moves downward, the BPOP 63 is initially covered (except at very small rack bar positions) by the third portion 55 of the plunger 41. As the plunger 41 continues moving downward, after the plunger 41 has travelled a certain fixed distance, the BPCP 107 is covered by the first portion 51 of the plunger 41. Thus, injection always starts at a fixed time with respect to cam shaft rotation.

The amount of fuel injected for a single stroke of the plunger 41 is controlled by the position of the rack bar 47. When the rack bar 47 is pushed along its axis 49, it causes the pinion 43 and the plunger 41 to rotate about their common axis 49. Motion of the rack bar 47 is relatively slow as compared to the downward velocity of the plunger 41. Therefore, the rack bar 47 can be considered as being in a fixed position during the full stroke of the plunger 41.

During the period when both the BPCP 107 and BPOP 63 are covered, pressure increases in the fuel chamber 67. For a brief period while the pressure is building, the needle valve 93 is held shut by the preload in the needle valve spring 105, thus preventing flow out of the spray orifices 85. After the pressure against the step 99 becomes high enough to overcome the needle valve spring 105 preload, the needle valve 93 lifts until it hits the stop 103. This allows the high pressure fuel to flow out of the spray orifices 85 into the combustion chamber of the engine.

As the plunger 41 continues moving downward, the BPOP 63 is uncovered and fuel begins to flow from the fuel chamber 67 to the fuel supply manifold 109. The distance the plunger 41 must travel for the BPOP 63 to be uncovered is a function of plunger 41 rotation which is proportional to rack bar 47 position. Because of the orifice restriction 145 in the BPOP 63, the fuel in the fuel chamber 67 is maintained at a pressure higher than the fuel supply manifold 109 pressure. This pressure is transmitted as a pressure wave through the fourth pathway 143 to the top 147 of the spool valve 125 and overcomes the spool valve return spring 127 bias causing the spool valve 125 to travel to its flow off position at which the first land 133 controllably restricts, preferably completely cuts-off flow between the first and second portions 111, 113 of the fuel chamber 67. The space below the spool valve 125 containing the spool valve return spring 127 is vented to the fuel supply manifold 109 by a pathway (not shown) to prevent pressure buildup in this space.

When the spool valve 125 is in the flow off position, as shown in FIG. 6, three things occur: (a) pressure on the top 147 of the spool valve 125 is transmitted through the probe 129 to the needle valve stop 103 which along with the needle valve return spring 105 provides force to urge the needle valve 125 to close; (b) fuel flow from the plunger chamber 61 to the needle valve chamber 119 is limited or fully cut-off by the second land 133 of the spool valve 125, allowing pressure of sufficient magnitude to be maintained in the plunger chamber 67 thereby maintaining force against the bottom 57 of the plunger 41 thus preventing the drive mechanism 5 from separating; and (c) pressure in the needle valve chamber 119 is vented to the fuel supply manifold 109 through the third pathway 141 via the second pathway 117 and the spool valve annulus 135. Venting the pressure in the second portion 113 of the fuel chamber 67 allows quicker closure of the needle valve 93.

Once the plunger 41 reverses direction of travel and begins to move upward, pressure drops to its lowest value in the first portion 111 of the fuel chamber 67 and at the top 147 of the spool valve 125. The spool valve return spring 127 is then able to return the spool valve 125 to its flow on position.

Now looking at FIG. 6, the electronic injector 151 works in a similar manner. Before the drive mechanism 5 is set in motion, the rocker arm 29, the tappet 35 and the plunger 41 are held in the up position by the injector return spring 37, the spool valve 125 is held in the flow open position (shown in FIG. 4) by the spool valve return spring 127, the needle valve 93 is held in the injection off position by the needle valve return spring 105, and the solenoid 195 is in a de-energized state resulting in the poppet valve 185 being in an open, flow on, position.

The fuel chamber 197 is filled by fuel flowing from the fuel supply manifold 179 through the first branch 183 of the fourth pathway 181, around the poppet valve 185, into the fifth pathway 189, into the annulus 163, into the plunger bores 161, 157, into the plunger chamber 169, into the first pathway 167, into the second pathway 173, and into the needle valve chamber 175.

When the solenoid 195 is energized, the poppet 185 is pulled upward causing the poppet seal land 199 to seat and shut off bypass flow. As the plunger 155 moves downward, pressure increases in the fuel chamber 197 and injection occurs in a manner quite similar to the mechanical injector. Injection ends when the solenoid 195 is de-energized, opening the bypass around the poppet seal land 199. During fuel bypass, fuel flows from the plunger chamber 169, through the longitudinal 157 and lateral 161 bores in the plunger 155, through the internal annulus 163 of the barrel 165, through the fifth pathway 189, past the poppet 185, through the first branch 183 of the fourth pathway 181, through the restricted orifice 203, to the fuel supply manifold 179.

Because of the orifice restriction 203 in the fourth pathway 181, the fuel in the fuel chamber 197 is maintained at a pressure higher than the fuel supply manifold 179 pressure. This pressure is transmitted as a pressure wave through the second branch 187 of the fourth pathway 181 to the top 205 of the spool valve 153 and overcomes the spool valve return spring 207 bias causing the spool valve 153 to travel to its flow off position.

Other aspects, objects and advantages of this invention can be obtained from a study of the drawings, the disclosure, and the appended claims.

I claim:

1. A fuel injector, comprising:

a fuel chamber having first and second portions;

a fuel inlet connected to said fuel chamber;

a means for pressurizing fuel in said fuel chamber to a preselected injection pressure;

an injection valve in communication with said fuel chamber and displaceable between an injection off and an injection on position;

means forming a cavity between said first and second portions of said fuel chamber;

means within said cavity for interrupting the flow of fuel between said first and second portions of said fuel chamber, said means being displaceable between flow-on and flow-off positions;

a pressure wave pathway connected between said fuel chamber and said cavity for transmitting a pressure wave from said fuel chamber to said fuel flow interrupting means to displace said fuel flow interrupting means from its flow-on position to its flow-off position; and means for developing a hydraulic pressure wave in said fuel chamber;

wherein said displacement of said fuel flow interrupting means from said flow-on to said flow-off position by the force of said hydraulic pressure wave does not cause a significant amount of fuel to flow into said second portion of said fuel chamber.

2. A fuel injector, comprising:

a fuel chamber having first and second portions;

a fuel inlet connected to said fuel chamber;

a means for pressurizing fuel in said fuel chamber to a preselected injection pressure;

an injection valve in communication with said fuel chamber and displaceable between an injection off and an injection on position;

means forming a cavity between said first and second portions of said fuel chamber;

means within said cavity for interrupting the flow of fuel between said first and second portions of said fuel chamber, said means being displaceable between flow-on and flow-off positions;

a pressure wave pathway connected between said fuel chamber and said cavity for transmitting a pressure wave from said fuel chamber to said fuel flow interrupting means to displace said fuel flow interrupting means from its flow-on position to its flow-off position;

means for developing a hydraulic pressure wave in said fuel chamber; and means for venting said pressure in said second portion of said fuel chamber when said fuel flow interrupting means is displaced from said flow-on position to said flow-off position.

* * * * *